US007253710B2

(12) United States Patent
Shen et al.

(10) Patent No.: US 7,253,710 B2
(45) Date of Patent: Aug. 7, 2007

(54) LATCHING MICRO-MAGNETIC SWITCH ARRAY

(75) Inventors: Jun Shen, Phoenix, AZ (US); Cheng Ping Wei, Gilbert, AZ (US)

(73) Assignee: Schneider Electric Industries SAS (FR)

( * ) Notice: Subject to any disclaimer, the term of this patent is extended or adjusted under 35 U.S.C. 154(b) by 0 days.

(21) Appl. No.: 11/179,809

(22) Filed: Jul. 13, 2005

(65) Prior Publication Data

US 2006/0146470 A1 Jul. 6, 2006

Related U.S. Application Data

(63) Continuation of application No. 10/326,611, filed on Dec. 23, 2002, now abandoned.

(60) Provisional application No. 60/341,864, filed on Dec. 21, 2001.

(51) Int. Cl.
*H01H 51/22* (2006.01)

(52) U.S. Cl. ..... 335/78; 200/181

(58) Field of Classification Search ..... 335/78; 200/181; 307/113, 116

See application file for complete search history.

(56) References Cited

U.S. PATENT DOCUMENTS 3,845,430 A 10/1974 Petkewicz et al.

(Continued)

FOREIGN PATENT DOCUMENTS

DE 19820821 C1 12/1999

(Continued)

OTHER PUBLICATIONS

Richard P. Feymann, "There's Plenty of Room at the Bottom", Dec. 29, 1959, pp. 1-12, Internet Source: http://222.zyvex.com/nanotech/feynman.html.

(Continued)

*Primary Examiner*—Elvin Enad
*Assistant Examiner*—Bernard Rojas
(74) *Attorney, Agent, or Firm*—Sterne Kessler Goldstein & Fox, PLLC

(57) ABSTRACT

Systems and methods for actuating micro-magnetic latching switches in an array of micro-magnetic latching switches are described. The array of switches is defined by Y rows aligned with a first axis and X columns aligned with a second axis. Each switch in the array of switches is capable of being actuated by a coil. In an aspect, a row of coils is moved along the second axis to be positioned adjacent to a selected one of the Y rows of switches. A sufficient driving current is proved to a selected coil in the row of coils to actuate a selected switch in the selected one of the Y rows of switches. In another aspect, a plurality of first axis drive signals and a plurality of second axis drive signals are generated. These signals drive an array of coils, wherein each coil in the array of coils is positioned adjacent to a corresponding switch in the array of switches. Each first axis drive signal is coupled to coils in a corresponding column of coils in the array of coils. Each second axis drive signal is coupled to coils in a corresponding row of coils in the array of coils. In another aspect, a three-dimensional array of switches is actuated by drive signals that drive a three-dimensional array of coils.

18 Claims, 12 Drawing Sheets

U.S. PATENT DOCUMENTS

| | | | | |
|---|---|---|---|---|
| 4,065,677 | A | 12/1977 | Micheron et al. | |
| 4,139,841 | A | 2/1979 | Roberts | |
| 4,461,968 | A | 7/1984 | Kolm et al. | |
| 4,496,211 | A | 1/1985 | Daniel | |
| 4,570,139 | A | 2/1986 | Kroll | |
| 5,016,978 | A | 5/1991 | Fargette et al. | |
| 5,048,912 | A | 9/1991 | Kunikane et al. | |
| 5,099,383 | A | 3/1992 | Fukano et al. | |
| 5,398,011 | A | 3/1995 | Kimura et al. | |
| 5,472,539 | A | 12/1995 | Saia et al. | |
| 5,475,353 | A | 12/1995 | Roshen et al. | |
| 5,557,132 | A | 9/1996 | Takahashi | |
| 5,629,918 | A | 5/1997 | Ho et al. | |
| 5,696,619 | A | 12/1997 | Knipe et al. | |
| 5,778,513 | A | 7/1998 | Miu et al. | |
| 5,784,190 | A | 7/1998 | Worley | |
| 5,818,316 | A | 10/1998 | Shen et al. | |
| 5,838,847 | A | 11/1998 | Pan et al. | |
| 5,847,631 | A | 12/1998 | Taylor et al. | |
| 5,898,515 | A | 4/1999 | Furlani et al. | |
| 5,945,898 | A | 8/1999 | Judy et al. | |
| 5,982,554 | A | 11/1999 | Goldstein et al. | |
| 6,016,092 | A | 1/2000 | Qiu et al. | |
| 6,016,095 | A | 1/2000 | Herbert | |
| 6,028,689 | A | 2/2000 | Michalicek et al. | |
| 6,078,016 | A | 6/2000 | Yoshikawa et al. | |
| 6,084,281 | A | 7/2000 | Fullin et al. | |
| 6,094,116 | A | 7/2000 | Tai et al. | |
| 6,094,293 | A | 7/2000 | Yokoyama et al. | |
| 6,115,231 | A | 9/2000 | Shirakawa | |
| 6,124,650 | A | 9/2000 | Bishop et al. | |
| 6,143,997 | A | 11/2000 | Feng et al. | |
| 6,160,230 | A | 12/2000 | McMillen et al. | |
| 6,396,975 | B1 * | 5/2002 | Wood et al. | 385/18 |
| 6,410,360 | B1 | 6/2002 | Steenberge | |
| 6,469,602 | B2 * | 10/2002 | Ruan et al. | 335/78 |
| 6,526,198 | B1 * | 2/2003 | Wu et al. | 385/18 |
| 6,650,455 | B2 | 11/2003 | Miles | |
| 2003/0223676 | A1 | 12/2003 | Bernstein | |
| 2005/0264472 | A1 * | 12/2005 | Rast | 345/30 |

FOREIGN PATENT DOCUMENTS

| | | | |
|---|---|---|---|
| DE | 10031569 | A1 | 2/2001 |
| EP | 9420 | A | 4/1980 |
| EP | 0452012 | A2 | 10/1991 |
| EP | 0452012 | A3 | 10/1991 |
| EP | 0685864 | A1 | 12/1995 |
| EP | 0709911 | A2 | 5/1996 |
| EP | 0709911 | A3 | 5/1996 |
| EP | 0780858 | A1 | 6/1997 |
| EP | 0887879 | A1 | 6/1998 |
| EP | 0869519 | A1 | 10/1998 |
| EP | 921591 | A1 | 6/1999 |
| FR | 2572546 | A1 | 5/1986 |
| JP | 54-161952 | | 12/1979 |
| JP | 4-275519 | | 10/1992 |
| JP | 6-251684 | | 9/1994 |
| WO | WO 97/39468 | | 10/1997 |
| WO | WO 98/34269 | | 8/1998 |
| WO | WO 9927548 | | 6/1999 |

OTHER PUBLICATIONS

E. Fullin, J. Gobet, H.A.C. Tilmans, and J. Bergvist, "A New Basic Technology for Magnetic Micro-Actuators", pp. 143-147.

Jack W. Judy and Richard S. Muller "Magnetically Actuated, Addressable Microstructures", Sep. 1997, Journal of Microelectromechanical Systems, vol. 6, No. 3, Sep. 1997, pp. 249-255.

Ezekiel JJ Kruglick and Kristofer SJ Pister, "Project Overview: Micro-Relays", Tech. Digital Solid-State Sensor and Actuator Workshop, 1998, Hilton Head 98 and 19th International Conference on Electric Contact Phenomena, Nuremberg, Germany, Sep. 1998 (Downloaded from Internet Source: hhp://www-bsac.eecs.berkeley.edu/Kruglick/relays/relays.html, on Jul. 12, 1999) 2 pgs.

Ezekiel J.J. Kruglick and Kristofer S.J. Pister, "Bistable MEMS Relays and Contact Characterization", Tech. Digital Solid-State Sensor and Actuator Workshop, Hilton Head, 1988 and 19th International Conference on Electric Contact Phenomena, Nuremberg, Germany, Sep. 1998, 5 pgs.

Laure K. Lagorce and Oliver Brand, "Magnetic Microactuators Based on Polymer Magnets", Mar. 1999, IEEE Journal of Microelectromechanical Systems, IEEE, vol. 8., No. 1., Mar. 1999, 8 pages.

"P10D Electricity & Magnetism Lecture 14", Internet Source: http://scitec.uwhichill.edu.bb/cmp/online/P10D/Lecture14/lect14.htn, Jan. 3, 2000, pp. 1-5.

"Ultraminiature Magnetic Latching to 5-relays SPDT DC TO C Band", Series RF 341, product information from Teledyne Relays, 1998.

M. Ruan et al., "Latching Microelectromagnetic Relays", Sensors and Actuators A 91 (Jul. 15, 2001), Copyright 2001 Elsevier Science B.V., pp. 346-350.

Xi-Qing Sun, K.R. Farmer, W.N. Carr,."A Bistable Microrelay Based on Two-Segment Multimorph Cantilever Actuators", 11th Annual Workshop on Micro Electrical Mechanical Systems, Heidelberg, Germany, IEEE, Jan. 25-29, 1998, pp. 154-159.

William P. Taylor and Mark G. Allen, "Integrated Magnetic Microrelays: Normally Open, Normally Closed, and Multi-Pole Devices", 1997 International Conference on Solid-State Sensors and Actuators, IEEE, Jun. 16-19, 1997, pp. 1149-1152.

William P. Taylor, Oliver Brand, and Mark G. Allen. "Fully Integrated Magnetically Actuated Micromachined Relays", Journal of Microelectromechanical Systems, IEEE, vol. 7, No. 2, Jun. 1998, pp. 181-191.

Tilmans, et al., "A Fully-Packaged Electromagetic Microrelay", Proc. MEMS '99, Orlando, FL, Jan. 17-21, 1999, copyright IEEE 1999, pp. 25-30.

William Trimmer, "The Scaling of Micromechanical Devices", Internet Source: http://home.earthlink.net/-trimmerw/mems/scale.html on Jan. 3, 2000 (adapted from article Microrobots and Micromechanical Systems by W.S.N. Trimmer, Sensors and Actuators, vol. 19, No. 3, Sep. 1989, pp. 267-287, and other sources).

John A. Wright and Yu-Chong Tai, "Micro-Miniature Electromagnetic Switches Fabricated Using MEMS Technology", Proceedings: 46th Annual International Relay Conference: NARM '98, Apr. 1998, pp. 13-1 to 13-4.

John A. Wright, Yu-Chong Tai and Gerald Lilienthal, "A Magnetostatic MEMS Switch for DC Brushless Motor Commutation", Proceedings Solid State Sensor and Actuator Workshop, Hilton Head, 1998, Jun. 1998, pp. 304-307.

John A. Wright, Yu-Chong Tai, and Shih-Chia Chang. "A Large-Force, Fully-Integrated MEMS Magnetic Actuator", Tranducers '97, 1997 International Conference on Solid State Sensors and Actuators, Chicago, Jun. 16-19, 1997.

Ann, Chong H. & Allen, Mark G., A Fully Integrated Micromagnetic Actuator With A Multilevel Meander Magnetic Core, 1992 IEEE, Solid-State Sensor and Actuator Workshop, Technical Digest, Hilton Head Island, South Carolina, Jun. 22-25, 1992, Technical Digest, pp. 14-17.

English-Language Abstract of DE 10031569, published Feb. 1, 2001, 1 page.

English-Language Abstract of DE 19820821, published Dec. 16, 1999, 1 page.

English-Language Abstract of EP 0780858, published Jun. 25, 1997, 1 page.

English-Language Abstract of EP 0869519, published Oct. 7, 1998, 1 page.

English-Language Abstract of FR 2572546, published May 2, 1986, 1 page.

English-Language Abstract of JP 4275519, published Oct. 1, 1992, 1 page.

English-Language Abstract of JP 6251684, published Sep. 9, 1994, 1 page.

English-Language Abstract of JP 54161952, published Dec. 22, 1979, 1 page.

English-Language Abstract of WO 9927548, published Jun. 3, 1999, 1 page.

* cited by examiner

LATCHING MICRO-MAGNETIC SWITCH ARRAY

CROSS-REFERENCE TO RELATED APPLICATIONS

This application is a continuation of U.S. application Ser. No. 10/326,611, filed Dec. 23. 2002, now abandoned, which claims priority to U.S. provisional Application No. 60/341,864, filed Dec. 21, 2001, which are both incorporated herein by reference.

BACKGROUND OF THE INVENTION

1. Field of the Invention

The present invention relates to electronic switches. More specifically, the present invention relates to an array of latching micro-magnetic switches.

2. Background Art

Switches are typically electrically controlled two-state devices that open and close contacts to effect operation of devices in an electrical or optical circuit. Relays, for example, typically function as switches that activate or de-activate portions of electrical, optical or other devices. Relays are commonly used in many applications including telecommunications, radio frequency (RF) communications, portable electronics, consumer and industrial electronics, aerospace, and other systems. More recently, optical switches (also referred to as "optical relays" or simply "relays" herein) have been used to switch optical signals (such as those in optical communication systems) from one path to another.

Although the earliest relays were mechanical or solid-state devices, recent developments in micro-electro-mechanical systems (MEMS) technologies and microelectronics manufacturing have made micro-electrostatic and micro-magnetic relays possible. Such micro-magnetic relays typically include an electromagnet that energizes an armature to make or break an electrical contact. When the magnet is de-energized, a spring or other mechanical force typically restores the armature to a quiescent position. Such relays typically exhibit a number of marked disadvantages, however, in that they generally exhibit only a single stable output (i.e., the quiescent state) and they are not latching (i.e., they do not retain a constant output as power is removed from the relay). Moreover, the spring required by conventional micro-magnetic relays may degrade or break over time.

Non-latching micro-magnetic relays are known. The relay includes a permanent magnet and an electromagnet for generating a magnetic field that intermittently opposes the field generated by the permanent magnet. The relay must consume power in the electromagnet to maintain at least one of the output states. Moreover, the power required to generate the opposing field would be significant, thus making the relay less desirable for use in space, portable electronics, and other applications that demand low power consumption.

A bi-stable, latching switch that does not require power to hold the states is therefore desired. Such a switch should also be reliable, simple in design, low-cost and easy to manufacture, and should be useful in optical and/or electrical environments.

Some applications require large numbers of switches. As a result, arrays of switches are sometimes used to meet the needs of the applications. For example, broadband (electrical or optical) communications systems employ cross-point switches for arrays that perform medium speed switching applications (as compared to fast packet switching). Cross-point switch arrays are typically expensive, and must be manufactured to meet high performance standards. Latching micro-magnetic switches are good for such applications.

Thus, what is needed is an array of latching micro-magnetic switches that in these environments, and provides a high level of performance, including a sufficient switching rate. Furthermore, what is desired is a "X-by-Y" latching micro-magnetic switching array that is "non-blocking." In other words, what is desired is a latching micro-magnetic switching array where any X input of the array can be switched to any Y output, or vice versa.

BRIEF SUMMARY OF THE INVENTION

Systems and methods for actuating micro-magnetic latching switches in an array of micro-magnetic latching switches are described. The array of switches is defined by Y rows aligned with a first axis and X columns aligned with a second axis. Each switch in the array of switches is capable of being actuated by a coil.

In an aspect, a row of coils is moved along the second axis to be positioned adjacent to a selected one of the Y rows of switches. A sufficient driving current is proved to a selected coil in the row of coils to actuate a selected switch in the selected one of the Y rows of switches.

In another aspect, a plurality of first axis drive signals is generated. A plurality of second axis drive signals is generated. The plurality of first axis drive signals and second axis drive signals are received at an array of coils. The array of coils is defined by Y rows and X columns of coils. Each coil in the array of coils is positioned adjacent to a corresponding switch in the array of switches. Each first axis drive signal is coupled to coils in a corresponding column of coils in the array of coils. Each second axis drive signal is coupled to coils in a corresponding row of coils in the array of coils. A selected coil in the array of coils is driven to actuate the corresponding switch in the array of switches.

Systems and methods for actuating micro-magnetic latching switches in a three-dimensional array of micro-magnetic latching switches are provided. The three-dimensional array of switches is defined by Y rows, X columns, and Z layers of micro-magnetic latching switches. Each switch in the array of switches is capable of being actuated by a coil.

In an aspect, a plurality of first axis drive signals is generated. A plurality of second axis drive signals is generated. The plurality of first axis drive signals and plurality of second axis drive signals are received at a three-dimensional array of coils. The three-dimensional array of coils is defined by Y rows, X columns, and Z layers of coils. Each coil in the three-dimensional array of coils is positioned adjacent to a corresponding switch in the three-dimensional array of switches. Each first axis drive signal is coupled to coils in a corresponding column of coils that reside in a particular layer of coils. Each second axis drive signal is coupled to coils in a corresponding row of coils that reside in a particular layer of coils. A selected coil in the three-dimensional array of coils is driven to actuate the corresponding switch in the three-dimensional array of switches.

The latching micro-magnetic switch of the present invention can be used in a wide range of products including household and industrial appliances, consumer electronics, military hardware, medical devices and vehicles of all types, just to name a few broad categories of goods. The latching micro-magnetic switch of the present invention has the advantages of compactness, simplicity of fabrication, and has good performance at high frequencies. Arrays of the latching micro-magnetic switches of the present invention may be used in cross-point switches, routers, and hubs that perform switching applications, and in other products, devices, and systems.

These and other objects, advantages and features will become readily apparent in view of the following detailed description of the invention.

BRIEF DESCRIPTION OF THE FIGURES

The above and other features and advantages of the present invention are hereinafter described in the following detailed description of illustrative embodiments to be read in conjunction with the accompanying drawing figures, wherein like reference numerals are used to identify the same or similar parts in the similar views.

Figure 1A:
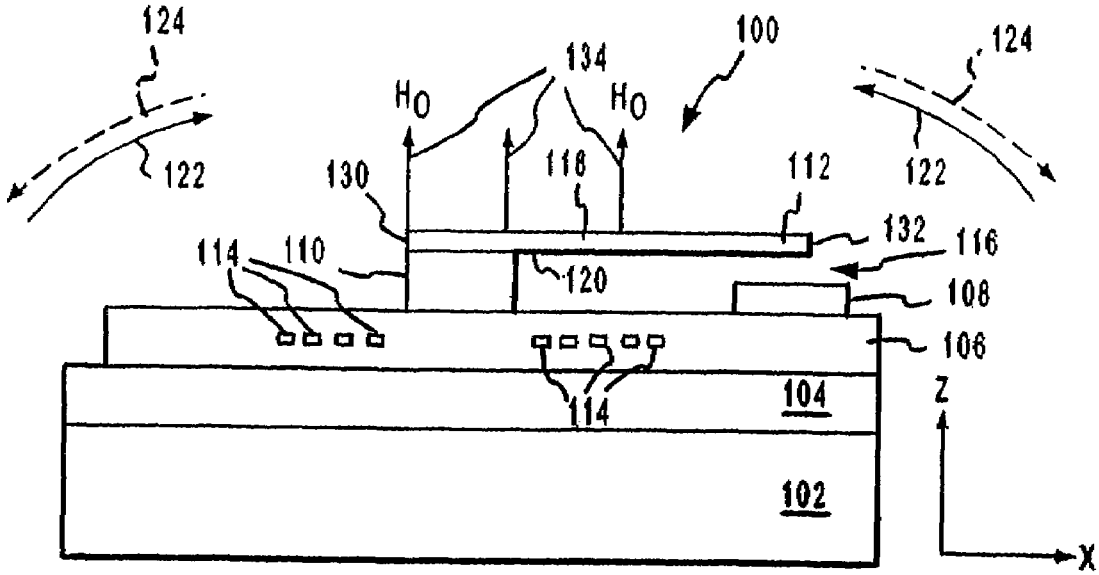
FIGS. 1A and 1B show side and top views, respectively, of an exemplary fixed-end latching micro-magnetic switch, according to an embodiment of the present invention.

The present invention will now be described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE INVENTION

Introduction

It should be appreciated that the particular implementations shown and described herein are examples of the invention and are not intended to otherwise limit the scope of the present invention in any way. Indeed, for the sake of brevity, conventional electronics, manufacturing, MEMS technologies and other functional aspects of the systems (and components of the individual operating components of the systems) may not be described in detail herein. Furthermore, for purposes of brevity, the invention is frequently described herein as pertaining to a micro-electronically-machined relay for use in electrical or electronic systems. It should be appreciated that many other manufacturing techniques could be used to create the relays described herein, and that the techniques described herein could be used in mechanical relays, optical relays or any other switching device. Further, the techniques would be suitable for application in electrical systems, optical systems, consumer electronics, industrial electronics, wireless systems, space applications, or any other application.

The terms, chip, integrated circuit, monolithic device, semiconductor device, and microelectronic device, are often used interchangeably in this field. The present invention is applicable to all the above as they are generally understood in the field.

The terms metal line, transmission line, interconnect line, trace, wire, conductor, signal path and signaling medium are all related. The related terms listed above, are generally interchangeable, and appear in order from specific to general. In this field, metal lines are sometimes referred to as traces, wires, lines, interconnect or simply metal. Metal lines, generally aluminum (Al), copper (Cu) or an alloy of Al and Cu, are conductors that provide signal paths for coupling or interconnecting, electrical circuitry. Conductors other than metal are available in microelectronic devices. Materials such as doped polysilicon, doped single-crystal silicon (often referred to simply as diffusion, regardless of whether such doping is achieved by thermal diffusion or ion implantation), titanium (Ti), molybdenum (Mo), and refractory metal silicides are examples of other conductors.

The terms contact and via, both refer to structures for electrical connection of conductors from different interconnect levels. These terms are sometimes used in the art to describe both an opening in an insulator in which the structure will be completed, and the completed structure itself. For purposes of this disclosure, contact and via refer to the completed structure.

The term vertical, as used herein, means substantially orthogonal to the surface of a substrate. Moreover, it should be understood that the spatial descriptions (e.g., "above", "below", "up", "down", "top", "bottom", etc.) made herein are for purposes of illustration only, and that practical latching relays can be spatially arranged in any orientation or manner.

The above-described micro-magnetic latching switch is further described in U.S. Pat. No. 6,469,602 (titled Electronically Switching Latching Micro-magnetic Relay And Method of Operating Same). This patent provides a thorough background on micro-magnetic latching switches and is incorporated herein by reference in its entirety.

An overview of a latching switch of the present invention is described in the following sections. This is followed by a detailed description of the operation and structure of arrays of micro-magnetic latching switches of the present invention. Then, a detailed description is provided for actuating switches in an array of switches of the present invention, according to the present invention.

Overview of a Latching Switch

Figure 1B:
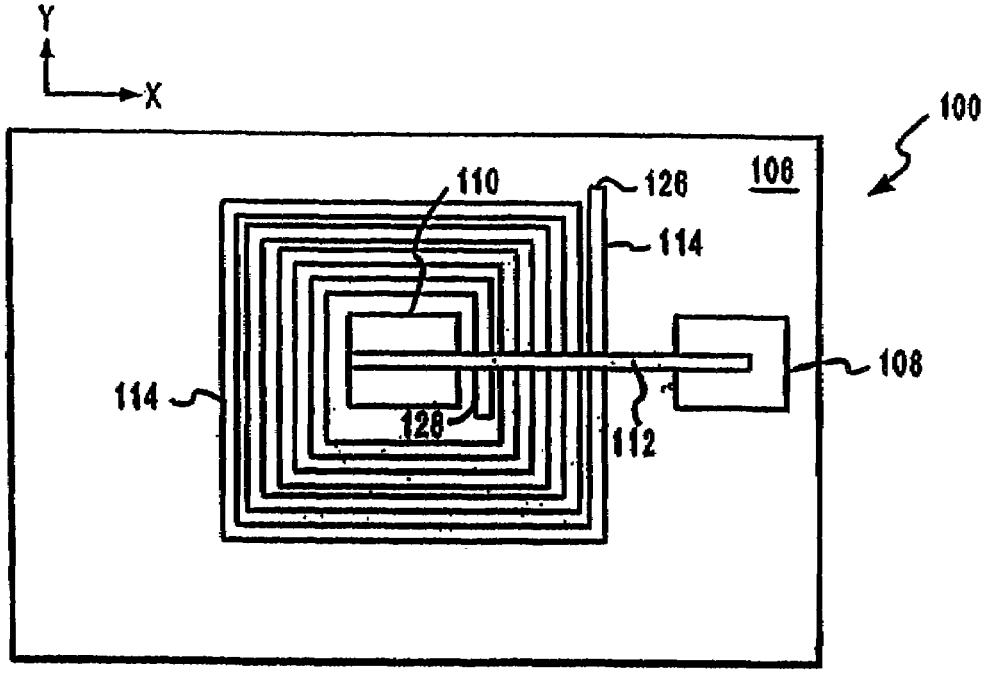

FIGS. 1A and 1B show side and top views, respectively, of a latching switch. The terms switch and device are used herein interchangeably to described the structure of the present invention. With reference to FIGS. 1A and 1B, an exemplary latching relay 100 suitably includes a magnet 102, a substrate 104, an insulating layer 106 housing a conductor 114, a contact 108 and a cantilever (moveable element) 112 positioned or supported above substrate by a staging layer 110.

Magnet 102 is any type of magnet such as a permanent magnet, an electromagnet, or any other type of magnet capable of generating a magnetic field $H_0$ 134, as described more fully below. By way of example and not limitation, the magnet 102 can be a model 59-P09213T001 magnet available from the Dexter Magnetic Technologies corporation of Fremont, Calif., although of course other types of magnets could be used. Magnetic field 134 can be generated in any manner and with any magnitude, such as from about 1 Oersted to $10^4$ Oersted or more. The strength of the field depends on the force required to hold the cantilever in a given state, and thus is implementation dependent. In the exemplary embodiment shown in FIG. 1A, magnetic field $H_0$ 134 can be generated approximately parallel to the Z axis and with a magnitude on the order of about 370 Oersted, although other embodiments will use varying orientations and magnitudes for magnetic field 134. In various embodiments, a single magnet 102 can be used in conjunction with a number of relays 100 sharing a common substrate 104.

Substrate 104 is formed of any type of substrate material such as silicon, gallium arsenide, glass, plastic, metal or any other substrate material. In various embodiments, substrate 104 can be coated with an insulating material (such as an oxide) and planarized or otherwise made flat. In various embodiments, a number of latching relays 100 can share a single substrate 104. Alternatively, other devices (such as transistors, diodes, or other electronic devices) could be formed upon substrate 104 along with one or more relays 100 using, for example, conventional integrated circuit manufacturing techniques. Alternatively, magnet 102 could be used as a substrate and the additional components discussed below could be formed directly on magnet 102. In such embodiments, a separate substrate 104 may not be required.

Insulating layer 106 is formed of any material such as oxide or another insulator such as a thin-film insulator. In an exemplary embodiment, insulating layer is formed of Probimide 7510 material. Insulating layer 106 suitably houses conductor 114. Conductor 114 is shown in FIGS. 1A and 1B to be a single conductor having two ends 126 and 128 arranged in a coil pattern. Alternate embodiments of conductor 114 use single or multiple conducting segments arranged in any suitable pattern such as a meander pattern, a serpentine pattern, a random pattern, or any other pattern. Conductor 114 is formed of any material capable of conducting electricity such as gold, silver, copper, aluminum, metal or the like. As conductor 114 conducts electricity, a magnetic field is generated around conductor 114 as discussed more fully below.

Cantilever (moveable element) 112 is any armature, extension, outcropping or member that is capable of being affected by magnetic force. In the embodiment shown in FIG. 1A, cantilever 112 suitably includes a magnetic layer 118 and a conducting layer 120. Magnetic layer 118 can be formulated of permalloy (such as NiFe alloy) or any other magnetically sensitive material. Conducting layer 120 can be formulated of gold, silver, copper, aluminum, metal or any other conducting material. In various embodiments, cantilever 112 exhibits two states corresponding to whether relay 100 is "open" or "closed", as described more fully below. In many embodiments, relay 100 is said to be "closed" when a conducting layer 120, connects staging layer 110 to contact 108. Conversely, the relay may be said to be "open" when cantilever 112 is not in electrical contact with contact 108. Because cantilever 112 can physically move in and out of contact with contact 108, various embodiments of cantilever 112 will be made flexible so that cantilever 112 can bend as appropriate. Flexibility can be created by varying the thickness of the cantilever (or its various component layers), by patterning or otherwise making holes or cuts in the cantilever, or by using increasingly flexible materials.

Although the dimensions of cantilever 112 can vary dramatically from implementation to implementation, an exemplary cantilever 112 suitable for use in a micro-magnetic relay 100 can be on the order of 10-1000 microns in length, 1-40 microns in thickness, and 2-600 microns in width. For example, an exemplary cantilever in accordance with the embodiment shown in FIGS. 1A and 1B can have dimensions of about 600 microns×10 microns×50 microns, or 1000 microns×600 microns×25 microns, or any other suitable dimensions.

Contact 108 and staging layer 110 are placed on insulating layer 106, as appropriate. In various embodiments, staging layer 110 supports cantilever 112 above insulating layer 106, creating a gap 116 that can be vacuum or can become filled with air or another gas or liquid such as oil. Although the size of gap 116 varies widely with different implementations, an exemplary gap 116 can be on the order of 1-100 microns, such as about 20 microns, Contact 108 can receive cantilever 112 when relay 100 is in a closed state, as described below. Contact 108 and staging layer 110 can be formed of any conducting material such as gold, gold alloy, silver, copper, aluminum, metal or the like. In various embodiments, contact 108 and staging layer 110 are formed of similar conducting materials, and the relay is considered to be "closed" when cantilever 112 completes a circuit between staging layer 110 and contact 108. In certain embodiments wherein cantilever 112 does not conduct electricity, staging layer 110 can be formulated of non-conducting material such as Probimide material, oxide, or any other material. Additionally, alternate embodiments may not require staging layer 110 if cantilever 112 is otherwise supported above insulating layer 106.

Figure 1C:
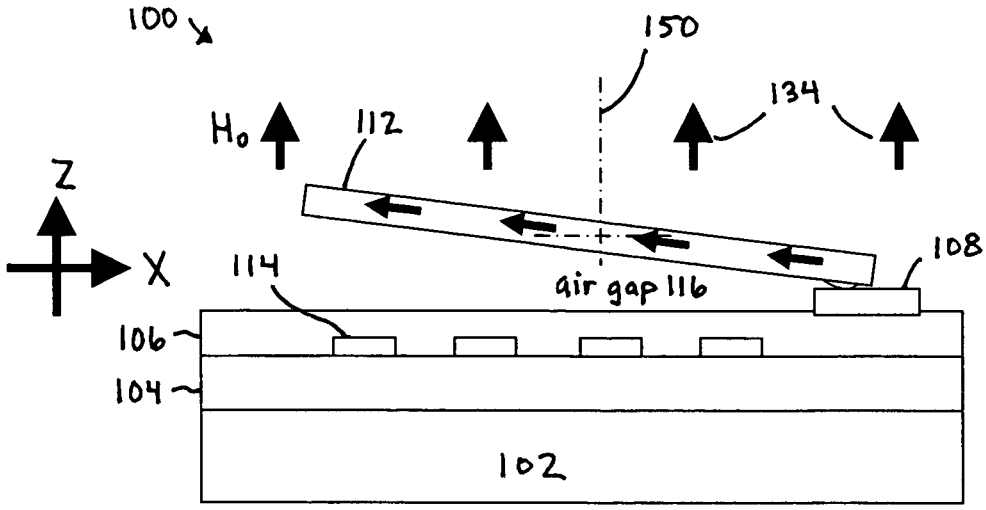
FIGS. 1C and 1D show side and top views, respectively, of an exemplary hinged latching micro-magnetic switch, according to an embodiment of the present invention.
Figure 1D:
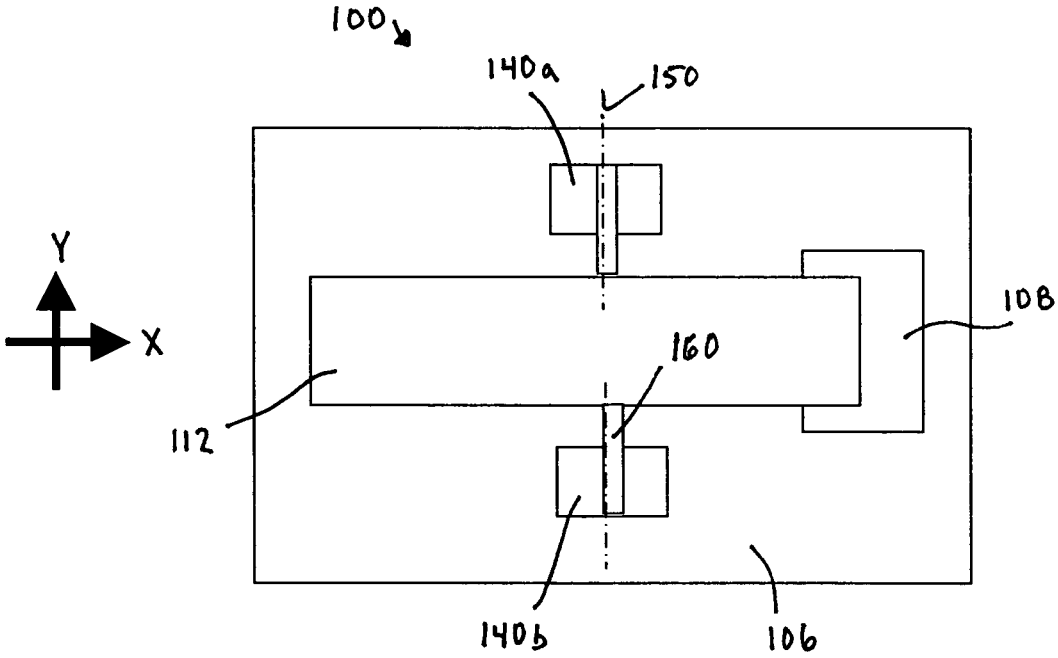

Alternatively, cantilever 112 can be made into a "hinged" arrangement. For example, FIGS. 1C and 1D show side and top views, respectively, of a latching relay 100 incorporating a hinge 160, according to an embodiment of the present invention. Hinge 160 centrally attaches cantilever 112, in contrast to staging layer 110, which attaches an end of cantilever 112. Hinge 160 is supported on first and second hinge supports 140*a* and 140*b*. Latching relay 100 shown in FIGS. 1C and 1D operates substantially similarly to the switch embodiment shown in FIGS. 1A and 1D, except that cantilever 112 flexes or rotates around hinge 160 when changing states. Indicator line 150 shown in FIG. 1C indicates a central axis of cantilever 112 around which cantilever 112 rotates. Hinge 160 and hinge supports 140*a* and 140*b* can be made from electrically or non-electrically conductive materials, similarly to staging layer 110. Relay 100 is considered to be "closed" when cantilever 112 completes a circuit between one or both of first and second hinge supports 140*a* and 104*b*, and contact 108.

Figure 1E:
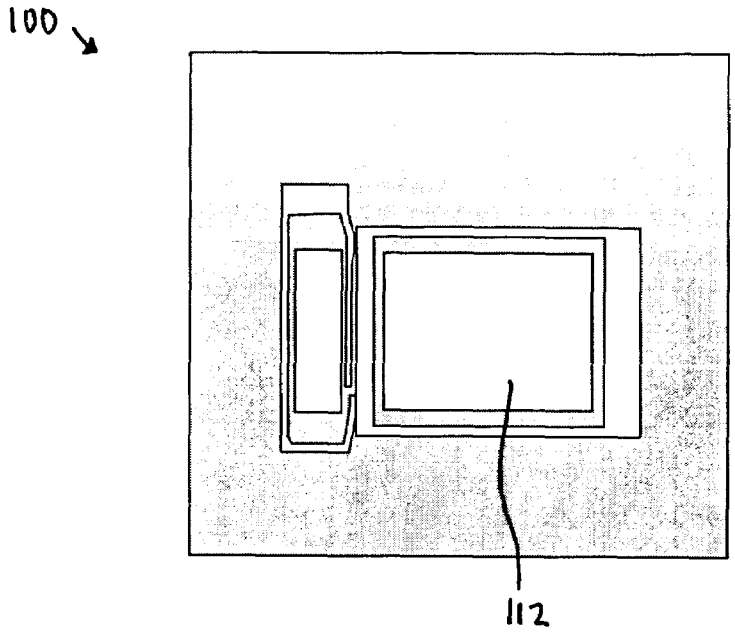
FIG. 1E shows an example implementation of the switch of FIGS. 1A and 1B, according to an embodiment of the present invention.
Figure 1F:
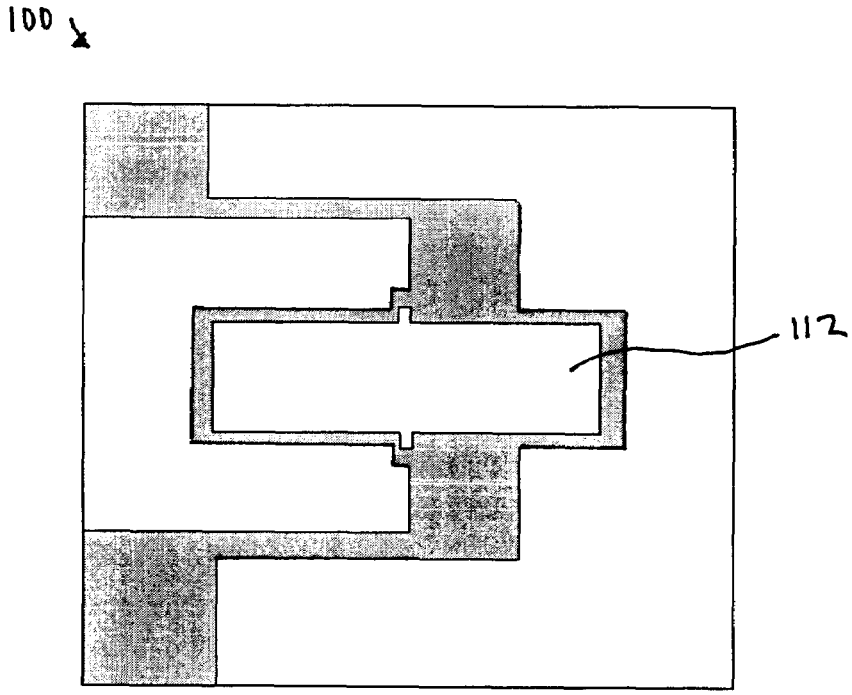
FIG. 1F shows an example implementation of the switch of FIGS. 1C and 1D, according to an embodiment of the present invention.

Relay 100 can be formed in any number of sizes, proportions, and configurations. FIGS. 1E and 1F show examples of relay 100, according to embodiments of the present invention. Note that the examples of relay 100 shown in FIGS. 1E and 1F are provided for purposes of illustration, and are not intended to limit the invention.

FIG. 1E shows an example relay 100 having a fixed end configuration, similar to the embodiment shown in FIGS. 1A and 1B. In the example of FIG. 1E, cantilever 112 has the dimensions of 700 μm×300 μm×30 μm. A thickness of cantilever 112 is 5 μm. Air gap 116 (not shown in FIG. 1E) has a spacing of 12 μm under cantilever 112. An associated coil 114 (not shown in FIG. 1E) has 20 turns.

FIG. 1F shows an example relay 100 having a hinge structure, similarly to the embodiment shown in FIGS. 1C and 1D. In the example of FIG. 1F, cantilever 112 has the dimensions of 800 μm×200 μm×25 μm. A pair of torsion flexures (not shown in FIG. 1F) are located in the center of cantilever 112 to provide the hinge function. Each flexure has dimensions of 280 μm×20 μm×3 μm. Air gap 116 (not shown in FIG. 1F) has a spacing of 12 μm under cantilever 112. An associated coil 114 (not shown in FIG. 1F) has 20 turns.

Principle of Operation of a Micro-Magnetic Latching Switch

When it is in the "down" position, the cantilever makes electrical contact with the bottom conductor, and the switch is "ON" (also called the "closed" state). When the contact end is "up", the switch is "OFF" (also called the "open" state). These two stable states produce the switching function by the moveable cantilever element. The permanent magnet holds the cantilever in either the "up" or the "down" position after switching, making the device a latching relay. A current is passed through the coil (e.g., the coil is energized) only during a brief (temporary) period of time to transition between the two states.

(i) Method to Produce Bi-stability

Figure 2:
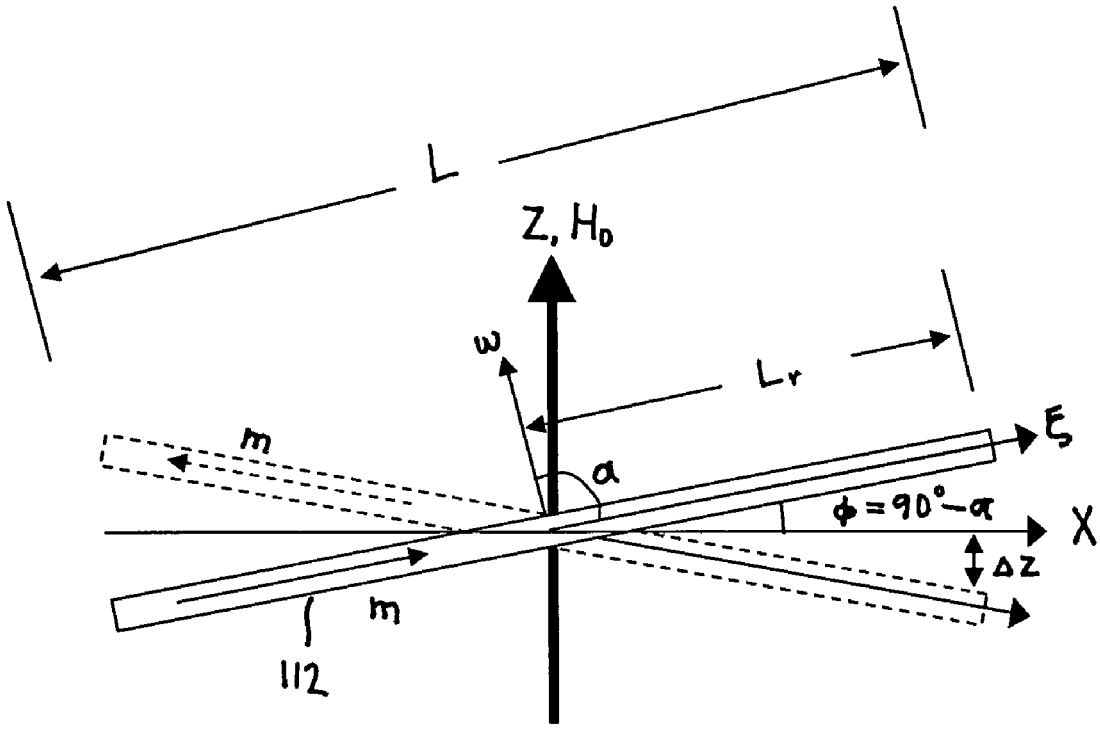
FIG. 2 illustrates the principle by which bi-stability is produced.

The principle by which bi-stability is produced is illustrated with reference to FIG. 2. When the length L of a permalloy cantilever 112 is much larger than its thickness t and width (w, not shown), the direction along its long axis L becomes the preferred direction for magnetization (also called the "easy axis"). When a major central portion of the cantilever is placed in a uniform permanent magnetic field, a torque is exerted on the cantilever. The torque can be either clockwise or counterclockwise, depending on the initial orientation of the cantilever with respect to the magnetic field. When the angle (α) between the cantilever axis (ξ) and the external field ($H_0$) is smaller than 90°, the torque is counterclockwise; and when a is larger than 90°, the torque is clockwise. The bi-directional torque arises because of the bi-directional magnetization (i.e., a magnetization vector "m" points one direction or the other direction, as shown in FIG. 2) of the cantilever (m points from left to right when α<90°, and from right to left when α>90°). Due to the torque, the cantilever tends to align with the external magnetic field ($H_0$). However, when a mechanical force (such as the elastic torque of the cantilever, a physical stopper, etc.) preempts to the total realignment with $H_0$, two stable positions ("up" and "down") are available, which forms the basis of latching in the switch.

(ii) Electrical Switching

If the bi-directional magnetization along the easy axis of the cantilever arising from $H_0$ can be momentarily reversed by applying a second magnetic field to overcome the influence of ($H_0$), then it is possible to achieve a switchable latching relay. This scenario is realized by situating a planar coil under or over the cantilever to produce the required temporary switching field. The planar coil geometry was chosen because it is relatively simple to fabricate, though other structures (such as a wrap-around, three dimensional type) are also possible. The magnetic field (Hcoil) lines generated by a short current pulse loop around the coil. It is mainly the ξ-component (along the cantilever, see FIG. 2) of this field that is used to reorient the magnetization (magnetization vector "m") in the cantilever. The direction of the coil current determines whether a positive or a negative ξ-field component is generated. Plural coils can be used. After switching, the permanent magnetic field holds the cantilever in this state until the next switching event is encountered. Since the ξ-component of the coil-generated field (Hcoil-ξ) only needs to be momentarily larger than the ξ-component [$H_0\xi \sim H_0 \cos(\alpha)=H_0 \sin(\phi)$, $\alpha=90°-\phi$]of the permanent magnetic field and φ is typically very small (e.g., $\phi \leqq 5°$), switching current and power can be very low, which is an important consideration in micro relay design.

The operation principle can be summarized as follows: A permalloy cantilever in a uniform (in practice, the field can be just approximately uniform) magnetic field can have a clockwise or a counterclockwise torque depending on the angle between its long axis (easy axis, L) and the field. Two bi-stable states are possible when other forces can balance die torque. A coil can generate a momentary magnetic field to switch the orientation of magnetization (vector m) along the cantilever and thus switch the cantilever between the two states.

Relaxed Alignment of Magnets

To address the issue of relaxing the magnet alignment requirement, the inventors have developed a technique to create perpendicular magnetic fields in a relatively large region around the cantilever. The invention is based on the fact that the magnetic field lines in a low permeability media (e.g., air) are basically perpendicular to the surface of a very high permeability material (e.g., materials that are easily magnetized, such as permalloy). When the cantilever is placed in proximity to such a surface and the cantilever's horizontal plane is parallel to the surface of the high permeability material, the above stated objectives can be at least partially achieved. The generic scheme is described below, followed by illustrative embodiments of the invention.

The boundary conditions for the magnetic flux density (B) and magnetic field (H) follow the following relationships:

$$B_2 \cdot n = B_1 \cdot n,\ B_2 \times n = (\mu_2/\mu_1) B_1 \times n$$

or $$H_2 \cdot n = (\mu_2/\mu_1) H_1 \cdot n,\ H_2 \times n = H_1 \times n$$

Figure 3:
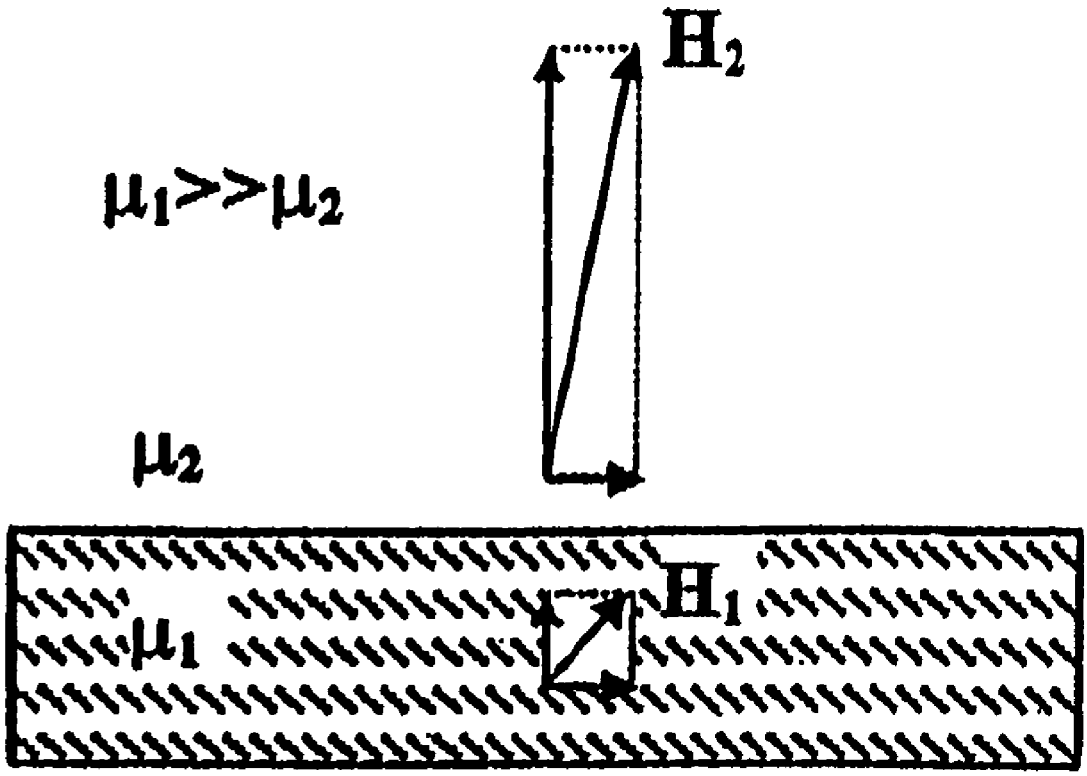
FIG. 3 illustrates the boundary conditions on the magnetic field (H) at a boundary between two materials with different permeability (1>>2).

If μ1>>μ2, the normal component of H2 is much larger than the normal component of H1, as shown in FIG. 3. In the limit (μ1/μ2)□□, the magnetic field H2 is normal to the boundary surface, independent of the direction of H1 (barring the exceptional case of H1 exactly parallel to the interface). If the second media is air (μ2=1), then B2=μ0 H2, so that the flux lines B2 will also be perpendicular to the surface. This property is used to produce magnetic fields that are perpendicular to the horizontal plane of the cantilever in a micro-magnetic latching switch and to relax the permanent magnet alignment requirements.

This property, where the magnetic field is normal to the boundary surface of a high-permeability material, and the placement of the cantilever (i.e., soft magnetic) with its horizontal plane parallel to the surface of the high-permeability material, can be used in many different configurations to relax the permanent magnet alignment requirement.

Latching Micro-Magnetic Switch Array of the Present Invention

The micro-magnetic latching switches described above can be formed into arrays, and selected switches therein can be actuated, according to embodiments of the present invention, as described below. These embodiments are provided for illustrative purposes only, and are not limiting. Alternative embodiments will be apparent to persons skilled in the relevant art(s) based on the discussion contained herein. As will be appreciated by persons skilled in the relevant art(s), other latching switch array configurations and actuation schemes are within the scope and spirit of the present invention.

In embodiments of the present invention, arrays of switches are formed. Switches in the arrays of switches are actuated by a coil that is either moved or permanently resides closely positioned to the switch. The closely positioned coil is positioned sufficiently close to the corresponding switch so that it can actuate the switch when a sufficient current is applied thereto.

In some conventional switch arrays, because the coils are not rectified, (i.e., do not limit the flow of current to one direction), the addressing of individual switches is difficult. However, embodiments of the present invention overcome this problem by separating the array of switches from a driving coil array. Examples of such embodiments are described below.

Figure 4:
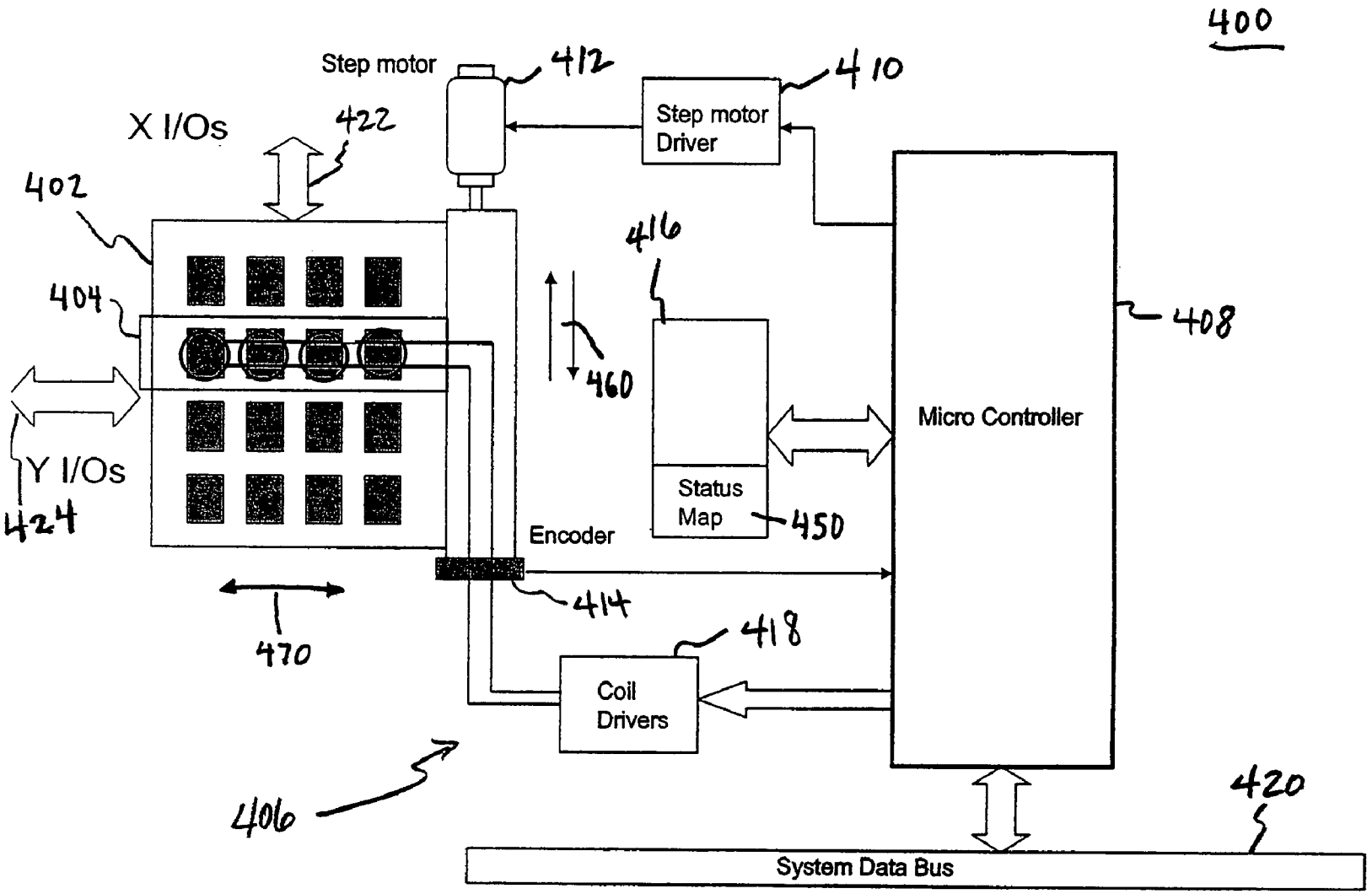
FIG. 4 illustrates a latching micro-magnetic switch array, according to the present invention.

For example, FIG. 4 illustrates a system 400 for actuating micro-magnetic latching switches in an array of micro-magnetic latching switches 402. As shown in FIG. 4, the array of switches 402 is defined by Y rows of switches aligned with a first axis 470, and X columns of switches aligned with a second axis 460. Signals are input and output to/from array of switches 402 via X and Y input/output ports, shown generally at 422 and 424, respectively. The switches of array of switches 402 can be single pull-single throw (SPST), single pull-double throw (SPDT), double pull-double throw (DPDT), or the like. Array of switches 402 can be populated entirely by the same type of switch (e.g., all SPDT), or can be populated by different switch types. An example of a switch applicable to array of switches 402 is switch 100, which is described above with respect to FIGS. 1A-1D.

System 400 shown in FIG. 4 also includes a one dimensional row of coils 404 and a driving circuit 406. Driving circuit 406 includes a micro controller 408, a step motor driver 410, a step motor 412, an encoder 414, a memory 416, coil drivers 418 and a system data bus 420.

Micro controller 408 provides instructions/commands to step motor driver 410 and coil drivers 414 to cause them to respectively operate. Micro controller 408 may be any controller, such as a processor, microprocessor, or the like, and can be a conventional type, or can be application specific, such as an application specific integrated circuit (ASIC) or other analog/digital circuit. Micro controller 408 may include hardware, software, or firmware, or any combination thereof.

Row of coils 404 is a structure that includes a number of individually addressable coils. The coils of row of coils 404 operate similarly to coils 114 described above with respect to FIGS. 1A and 1C. Row of coils 404 is moveable by step motor 412. Step motor 412 is capable of moving row of coils 404 along second axis 460 to be positioned adjacent to any one of the rows of switches in array of switches 402. When row of coils 404 is positioned adjacent to a selected row of switches in array of switches 402, each coil in row of coils 404 is positioned adjacent to a corresponding switch in the selected row of switches, such that the coil may actuate the corresponding switch.

In response to instructions from micro controller 408, step motor driver 410 causes step motor 412 to position the row of coils 404 over a particular row of switches of array of switches 402 in which a desired switch to be actuated resides. Encoder 414 monitors and/or detects/determines a position of row of coils 404 along the second axis 460, and provides the position data to micro controller 408. When row of coils 404 is in position, as determined by encoder 414, micro controller 408 commands coil drivers 418 to pass a current through the coil in the column associated with the particular switch to be actuated. The current is sufficient enough to actuate the particular switch.

Note that in an embodiment, micro controller 408 can use position data provided by encoder 414 to determine a distance that row of coils 404 needs to be moved along second axis 460 to be in the desired position.

Off-the-shelf or application specific mechanical or optical encoders, step motors, and step motor drivers can be employed for encoder 414, step motor 412, and step motor drivers 410, respectively. Coil drivers 418 can be fabricated using conventional analog and/or digital circuits to provide the sufficient driving current for a coil, as would be apparent to a person skilled in the relevant art based on this disclosure and those incorporated by reference.

In an embodiment, a memory 416 can be present in system 400. When present, memory 416 is coupled to micro controller 408, and stores information related to array of switches 402, row of coils 404, and/or other information. Memory 416 can be any type of memory, including volatile or non-volatile, and can be a random access memory (RAM) or other memory device type. In an embodiment, state information for each switch in array of switches 402 can be stored by micro controller 408 in a portion of memory 416, referred to as a status map 416. For example, status map 416 can store state information indicating whether a switch is open or closed.

A system data bus 420 can be coupled to micro controller 408. System data bus 420 allows communication with micro controller 408 by other components, devices, or systems, not shown in FIG. 4 System data bus 420 can monitor and/or transfer data related to system 400, including a status of all switches, selected rows, selected columns, or one or more individual switches of array of switches 402.

Note that a system initiation process can be performed to set the switches of array of switches 402 to a predetermined state. For example, micro controller 408 can send instructions to step motor driver 410 to have step motor 412 sequentially align row of coils 404 with each row of switches in array of switches 402. Concurrently, micro controller 408 can send instructions to coil drivers 418 to drive each coil in row of coils 404, one at a time, or simultaneously. In this manner, all switches in array of switches 404 can be actuated into the predetermined state.

According to this embodiment of the present invention, wafer level switches can be used in array of switches 402. This is because the spacing of switches in array of switches 402 is not limited by the ability to X-Y address the non-rectified coils of row of coils 404. In alternative embodiments, however, non-wafer level switches may be used in array of switches 402.

Figure 5:
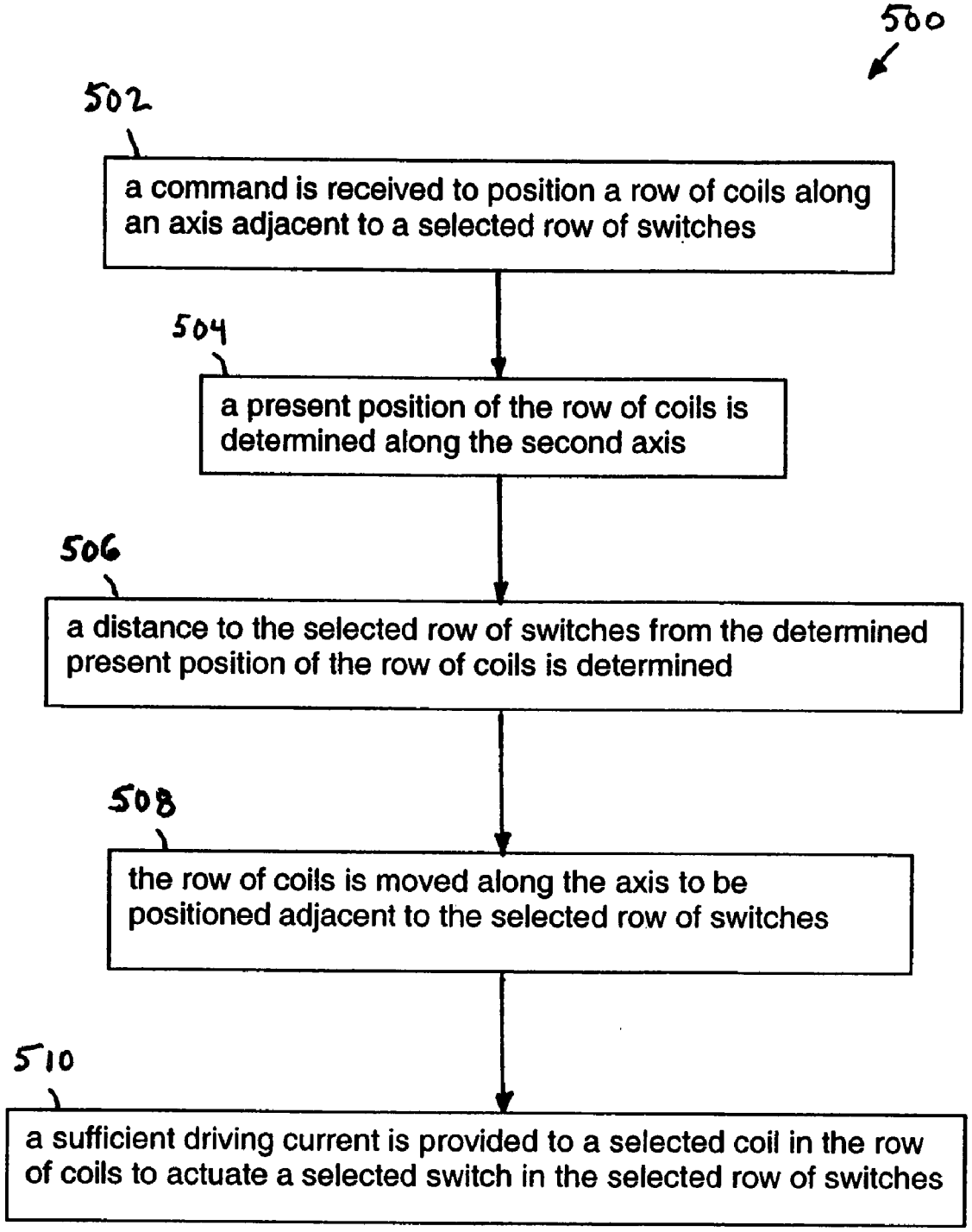
FIG. 5 shows a flowchart providing steps for operating a latching micro-magnetic switch array, according to an example embodiment of the present invention.

FIG. 5 shows a flowchart 500 providing steps for actuating a micro-magnetic latching switch in an array of switches, according to an example embodiment of the present invention. For example, flowchart 500 is applicable to a system configured similarly to system 400. The steps of flowchart 500 do not necessarily have to occur in the order shown, as will be apparent to persons skilled in the relevant art(s) based on the teachings herein. Other structural and operational embodiments will be apparent to persons skilled in the relevant art(s) based on the following discussion. These steps are described in detail below.

Flowchart 500 begins with step 502. In step 502, a command is received to position the row of coils along an axis adjacent to a selected row of switches. For example, micro controller 408 issues a command or instruction to step motor driver 410 to drive step motor 412 to position row of coils 404 along second axis 460. Row of coils 404 are positioned adjacent to a row of switches in array of switches 402 that is selected by micro controller 408.

In step 504, a present position of the row of coils along the axis is determined. For example, encoder 414 can determine the present position of row of coils 404 along second axis 460. In an alternative embodiment, step 504 is not necessary.

In step 506, a distance to the selected row of switches from the determined present position of the row of coils is determined. For example, micro controller 408 calculates the distance to the selected row of switches in the array of switches 402, using the position of row of coils 404 determined by encoder 414. In an alternative embodiment, step 506 is not necessary.

In step 508, a row of coils is moved along the axis to be positioned adjacent to the selected row of switches. In an embodiment, row of coils 404 is moved by step motor 412 to be positioned adjacent to the selected row of switches. In an embodiment, row of coils 404 can be moved the distance determined by micro controller 408. In another embodiment, row of coils 404 can be moved until encoder 414 determines that row of coils 404 is positioned adjacent to the selected row of switches. Micro controller 408 receives the position of row of coils 404 from encoder 414, and instructs step motor driver 410 to stop driving step motor 412.

In step 510, a sufficient driving current is provided to a selected coil in the row of coils to actuate a selected switch in the selected row of switches. For example, coil drivers 418 outputs a sufficient driving current to a selected coil in row of coils 404, as instructed by micro controller 408. The driving current is sufficient to actuate the switch selected by micro controller 408.

Figure 6:
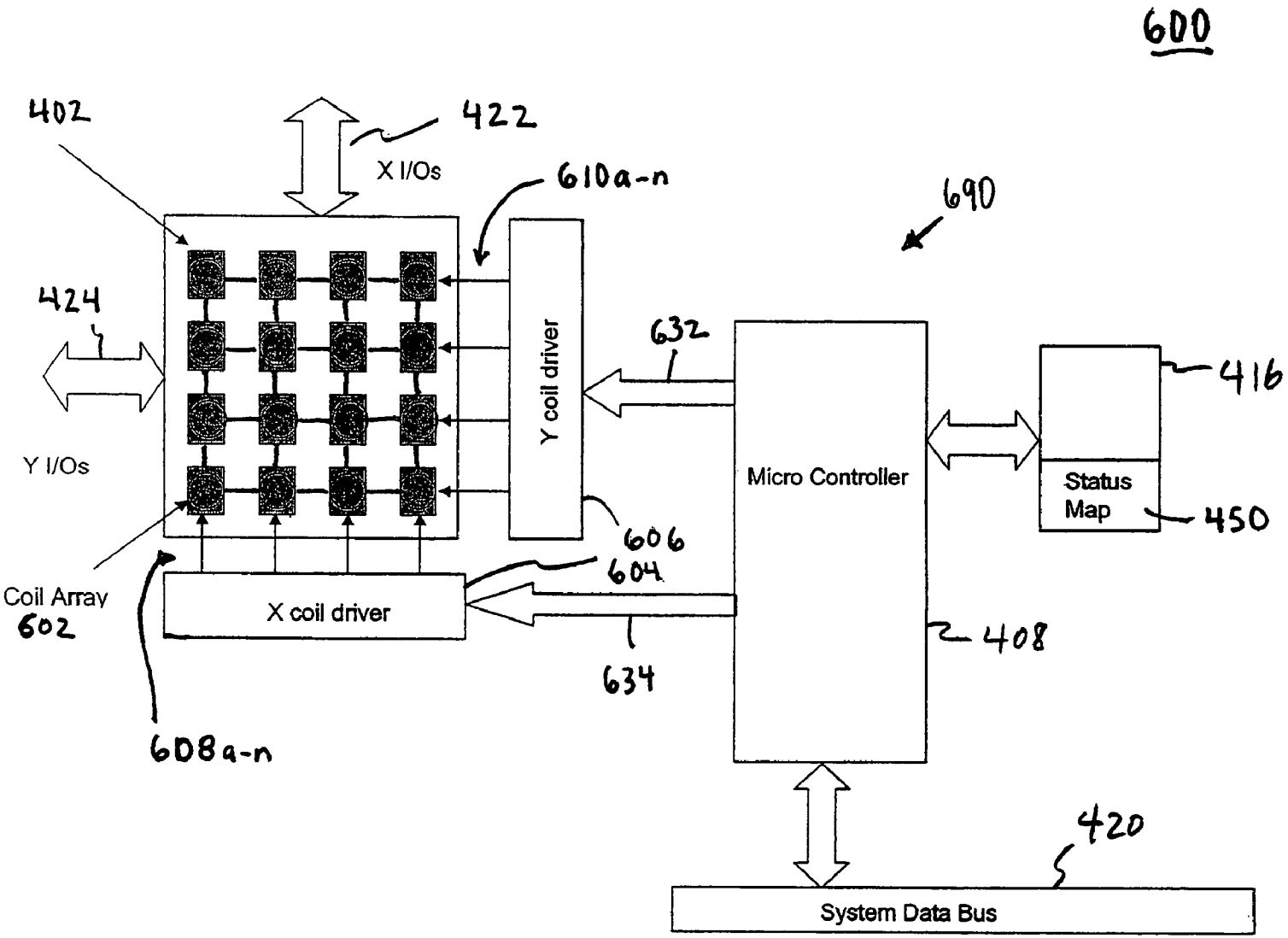
FIG. 6 illustrates active driver approach, according to another embodiment of the present invention.

In another example, FIG. 6 illustrates a system 600 for actuating micro-magnetic latching switches in an array of micro-magnetic latching switches 402. FIG. 6 illustrates an active driver approach, according to another embodiment of the present invention. In system 600, an array of coils 602 is present that includes a coil for each switch in array of switches 402. Array of coils 602 may be physically separate from array of switches 402, or may be integrated into the same substrate or other structure as array of switches 402.

System 600 shown in FIG. 6 includes array of switches 402, array of coils 602, and a driving circuit 690. Driving circuit 690 includes micro controller 408, memory 416, system data bus 420, a first axis (e.g., X-axis) coil driver 604, and a second axis (e.g., Y-axis) coil driver 606.

In an embodiment, a selected coil of array of coils 602 is driven to actuate a corresponding switch in the array of switches 402, as follows. Micro controller 408 provides signals to first axis and second axis coil drivers 604 and 606 to cause the selected coil to be driven. Micro controller 408 provides first axis coil drive instruction 634 to first axis coil driver 604, and provides second axis coil drive instruction 632 to second axis coil driver 606. First axis coil driver 604 outputs a plurality of first axis coil drive signals 608*a-n* to array of coils 602. Each first axis coil drive signal 608 is coupled to a corresponding column of coils in array of coils 602. Second axis coil driver 606 outputs a plurality of second axis coil drive signals 610*a-n* to array of coils 602. Each second axis coil drive signal 610 is coupled to a corresponding row of coils in array of coils 602. First axis coil drive instruction 634 causes first axis coil driver 604 to drive or activate a single first axis drive signal 610 that corresponds to a selected column of coils in the array of coils 602. Second axis coil drive instruction 632 causes second axis coil driver 604 to drive or activate a second axis drive signal 608 that corresponds to a selected column of coils in the array of coils 602. The coil in array of coils 602 at the intersection of the selected row of coils and column of coils is thus activated or driven, and causes actuation of the corresponding switch in array of switches 402.

Note that depending on the integration of the coil and drivers in system 600, the array of switches 402 potentially may not be formed as densely than the motorized approach of system 400 shown in FIG. 4.

Figure 7:
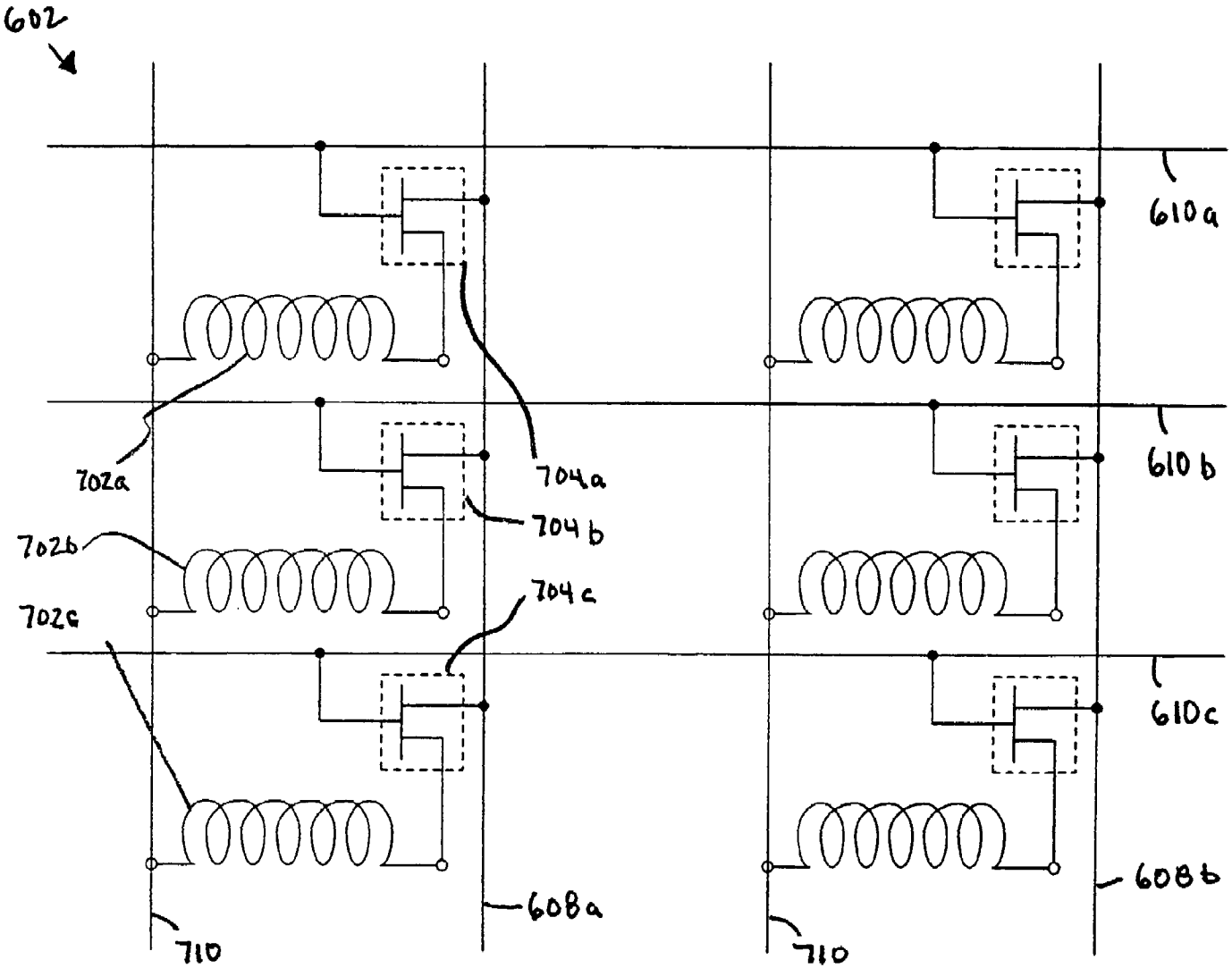
FIG. 7 is a schematic of a coil array with active driving elements.

Techniques for biasing of the coils in array of coils 602 using first axis and second axis coil drivers 604 and 606 will be apparent to persons skilled in the relevant art based on the teachings herein. For example, FIG. 7 shows an schematic of array of coils 602 with active driving elements, according to an embodiment of the present invention. In the embodiment of FIG. 7, array of coils 602 includes individual coils 702 that can be switched by addressing a corresponding transistor 704. For example, transistors 704*a-c* are addressed by a combination of first axis coil drive signal 608*a* and a corresponding one of second axis drive control signals 610*a-c*. By driving or activating first axis coil drive signal 608*a*, and one of second axis coil drive signals 610*a-c*, a corresponding one of transistors 704*a-c* is addressed. Thus, one of coils 702*a-c* that correspond to the addressed transistor 704*a-c* is driven, and actuates a corresponding switch. Alternatively, array of coils 602 can be configured in other ways than shown in FIG. 7.

First and second axis coil drive signals 608 and 610 can be activated or driven in a variety of ways by first and second coil drivers 604 and 606, depending on the particular configuration of the array of coils 602, as would be understood by persons skilled in the relevant art(s). For example, and not by way of limitation, the coil drive signals may be pulsed positively or negatively, a polarization of a coil drive signal to a transistor may be reversed, or a pulse applied to the drain of the driving transistor can be positive or negative.

In an example embodiment, transistors 704 shown in FIG. 7 are required to produce about 100 mA, which is approximately the current required to change the state of an example latching micro-magnetic switch. In alternative embodiments, switches having other current requirements are used. Hence, transistor 704 may be required to supply lower or higher alternative current amounts.

Figure 8:
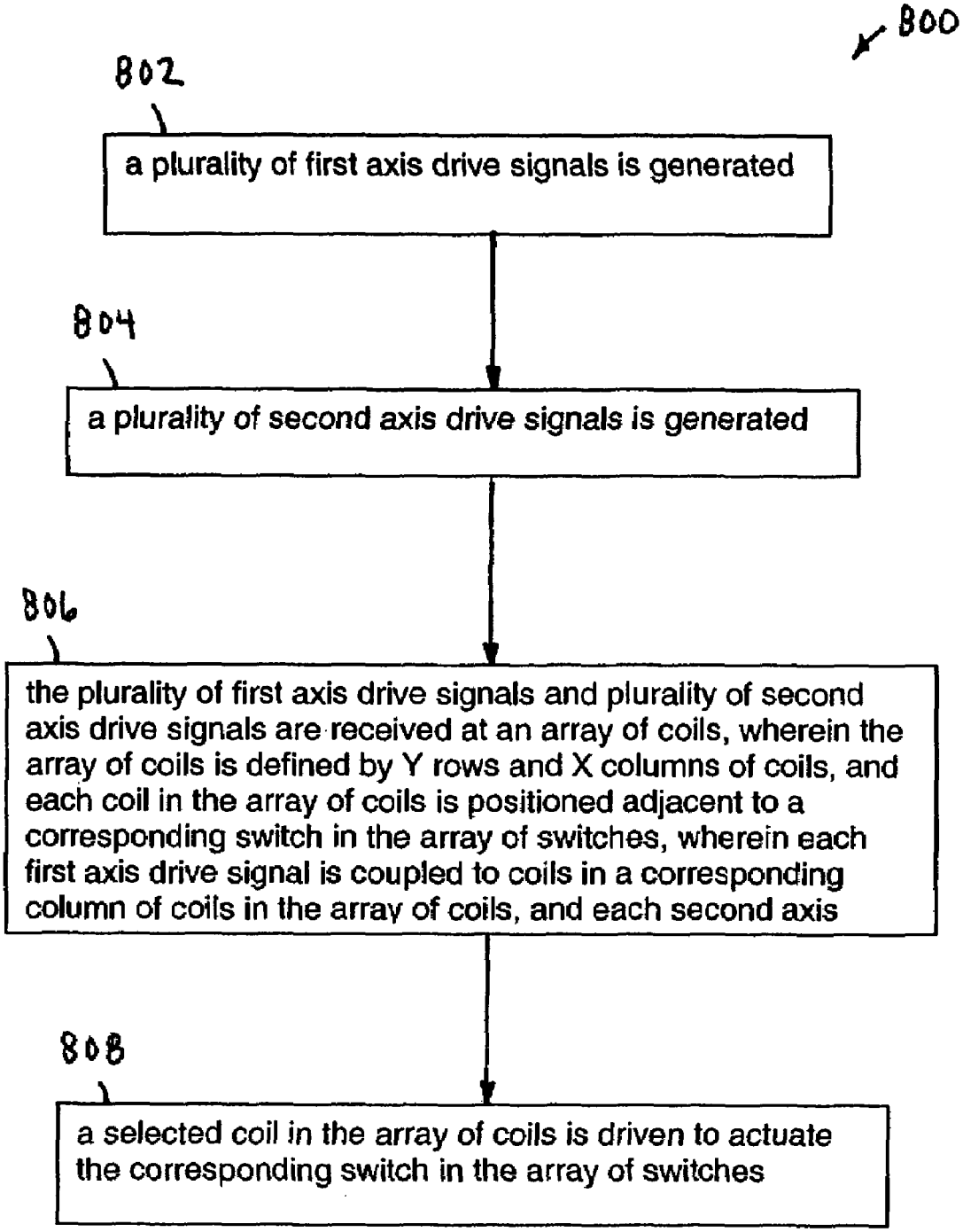
FIG. 8 shows a flowchart providing steps for operating a latching micro-magnetic switch array, according to an example embodiment of the present invention.

FIG. 8 shows a flowchart 800 providing steps for actuating a micro-magnetic latching switch in an array of switches, according to an example embodiment of the present invention. For example, flowchart 800 is applicable to a system configured similarly to system 600. The steps of flowchart 800 do not necessarily have to occur in the order shown, as will be apparent to persons skilled in the relevant art(s) based on the teachings herein. Other structural and operational embodiments will be apparent to persons skilled in the relevant art(s) based on the following discussion. These steps are described in detail below.

Flowchart 800 begins with step 802. In step 802, a plurality of first axis drive signals are generated. For example, the plurality of first axis drive signals are first axis drive signals 608*a-n*, which are generated by first axis coil driver 604.

In step 804, a plurality of second axis drive signals are generated. For example, the plurality of second axis drive signals are second axis drive signals 610*a-n*, which are generated by second axis coil driver 606.

In step 806, the plurality of first axis drive signals and plurality of second axis drive signals are received at an array of coils, wherein the array of coils is defined by Y rows and X columns of coils. Each coil in the array of coils is positioned adjacent to a corresponding switch in the array of switches. Each first axis drive signal is coupled to coils in a corresponding column of coils in the array of coils, and each second axis drive signal is coupled to coils in a corresponding row of coils in the array of coils. For example, the array of coils is array of coils 602, which receives first and second axis drive signals 608*a-n* and 610*a-n*. As described above, each coil of array of coils 602 is positioned adjacent to a corresponding switch in array of switches 402. First axis coil drive signals 608*a-n* are each coupled to coils in a corresponding column of coils. Second axis coil drive signals 610*a-n* are each coupled to coils in a corresponding row of coils.

In step 808, a selected coil in the array of coils is driven to actuate the corresponding switch in the array of switches. As described above, the coil in array of coils 602 at the intersection of the selected row of coils and column of coils activated or driven, to cause actuation of the corresponding switch in array of switches 402.

Figure 9:
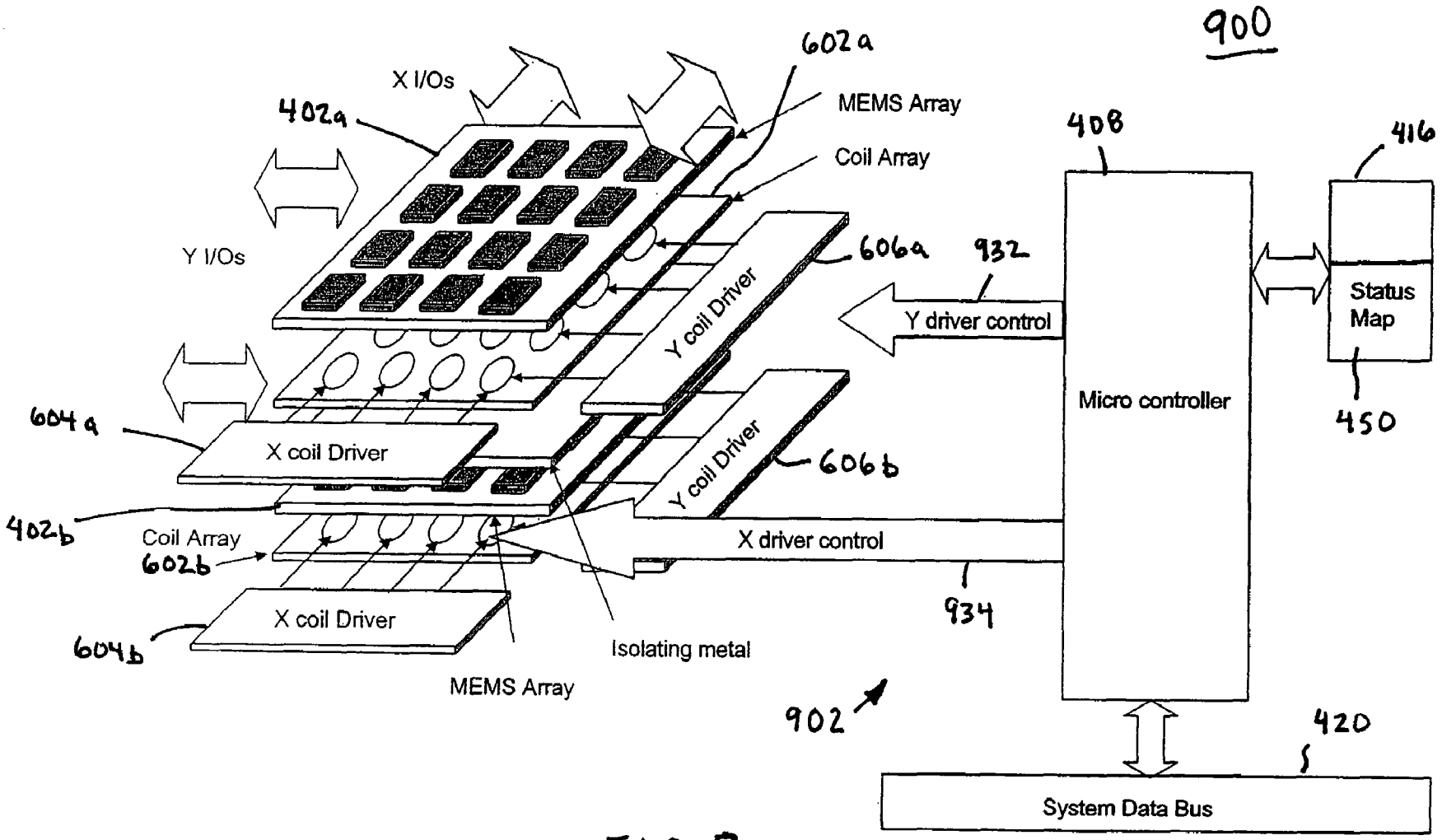
FIG. 9 illustrates 3-D array, according to another embodiment of the present invention.

In another example, FIG. 9 illustrates a system 900 for actuating micro-magnetic latching switches in an array of micro-magnetic latching switches 402. System 900 incorporates a three-dimensional array of switches 402*a-n*, according to another embodiment of the present invention. System 900 is similar to system 600 shown in FIG. 6, except that three dimensional switch array includes a plurality of layers of arrays of switches. Hence, the three-dimensional array of switches 402*a-n* can be referred to as an X by Y by Z array, defined by Y rows, X columns, and Z layers of arrays of switches 402. A three-dimensional array of coils 602*a-n* is present in system 900. Each coil in three-dimensional array of coils 602*a-n* is positioned adjacent to a corresponding switch in three-dimensional array of switches 402*a-n*. Thus, Z layers of arrays of coils 602 are present.

A plurality of first axis coil drivers 604*a-n* and a plurality of second axis coil drivers 606*a-n* are present in system 900 to drive coils in the three-dimensional array of coils 602*a-n*. Each layer of array of coils 602*a-n* in the three-dimensional array is coupled to a corresponding one of first axis coil drivers 604*a-n* and one of second axis coil drivers 606*a-n*, which activate or drive corresponding rows and columns of the particular array of coils 602.

Micro controller 408 provides signals to first and second axis coil drivers 604*a-n* and 606*a-n*, to cause them to drive or activate coils. First axis coil drive instruction 934 is output to first axis coil drivers 604*a-n*, and provides second axis coil drive instruction 932 is output to second axis coil drivers 606*a-n*. First and second axis coil drive instructions 934 and 932 may include signals that correspond to each of first and second axis coil drivers 604*a-n* and 606*a-n*, respectively. Thus, micro controller 408 can instruct first and second axis coil drivers 604*a-n* and 606*a-n* to actuate any switch in the three dimensional array of switches 402*a-n*.

EXAMPLE EMBODIMENTS FOR ACTUATING A MICRO-MAGNETIC LATCHING SWITCH IN AN ARRAY OF SWITCHES

Figure 10:
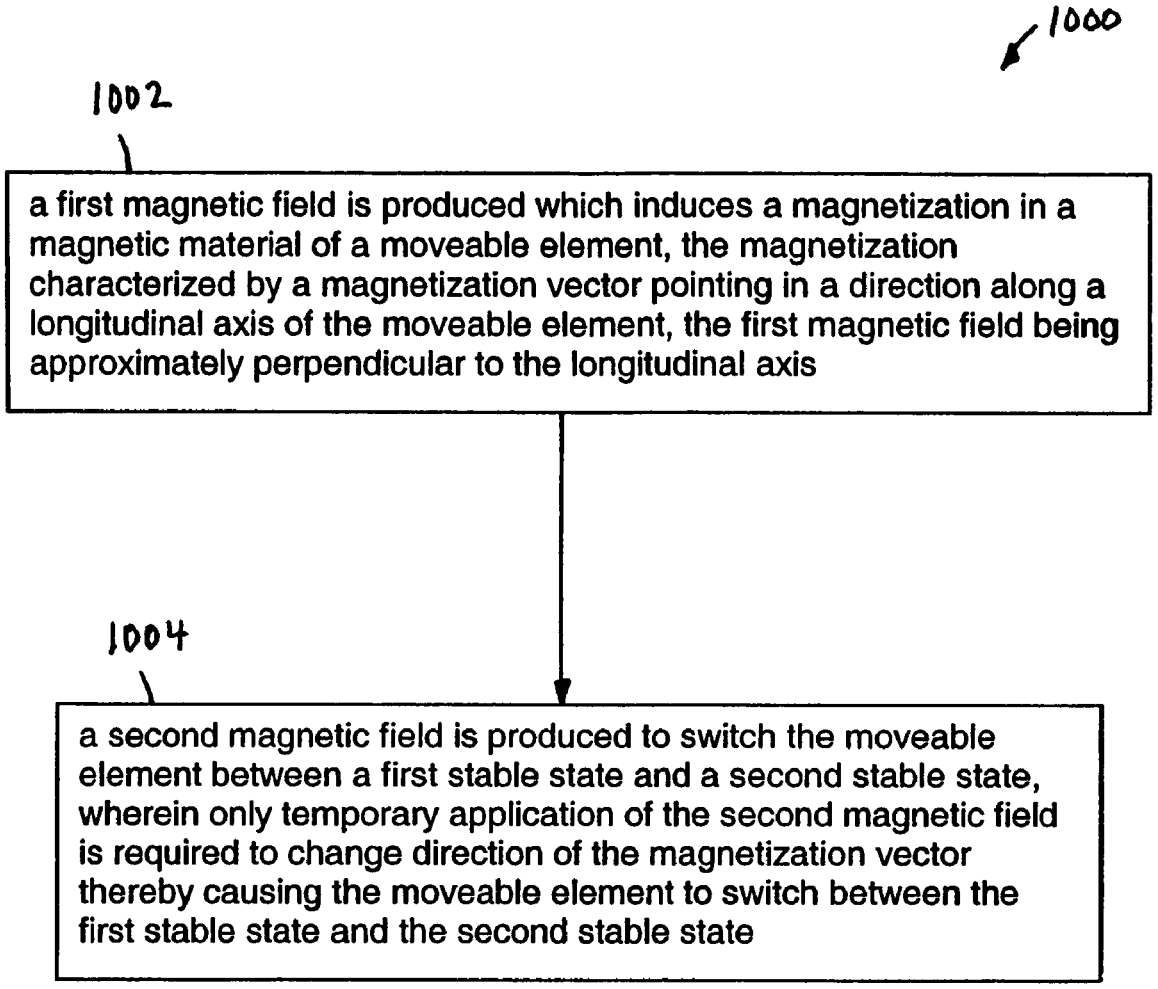
FIG. 10 shows a flowchart providing steps for operating a latching micro-magnetic switch, according to an example embodiment of the present invention.

FIG. 10 shows a flowchart 1000 providing steps for actuating a micro-magnetic latching switch in an array of switches, according to an example embodiment of the present invention. For example, flowchart 1000 applies to the actuation of switches in two and three dimensional arrays of switches, such switches in system 400 shown in FIG. 4, system 600 shown in FIG. 6, and system 900 shown in FIG. 9. In an embodiment, switches are configured similarly to switch or relay 100 shown in FIGS. 1A-1D, except where coil 114 may be physically separate from relay 100, such as in row of coils 404, or in a separate array of coils 602. Other structural and operational embodiments will be apparent to persons skilled in the relevant art(s) based on the following discussion. These steps are described in detail below.

Flowchart 1000 begins with step 1002. In step 1002, a first magnetic field is produced which induces a magnetization in a magnetic material of a moveable element, the magnetization characterized by a magnetization vector pointing in a direction along a longitudinal axis of the moveable element, the first magnetic field being approximately perpendicular to the longitudinal axis. For example, the first magnetic field is H0 134, as shown in FIGS. 1A and 1C. The magnetic field can be produced by magnet 102, which can be a permanent magnet. A magnet may be present for each switch or groups of switches, or a single magnet may produce the first magnetic field for the entire array of switches. In an alternative embodiment, the magnetic field is produced by more than one permanent magnet, such as a first permanent magnet above and a second permanent magnet below cantilever 112. A magnetization induced in the magnetic material can be characterized as a magnetization vector, such as magnetization vector "m" as shown in FIG. 2. As shown in FIGS. 1A and 1C, first magnetic field H0 134 is approximately perpendicular to a long axis L for cantilever 112 (e.g., as shown in FIG. 2).

In step 1004, a second magnetic field is produced to switch the moveable element between a first stable state and a second stable state, wherein only temporary application of the second magnetic field is required to change direction of the magnetization vector thereby causing the moveable element to switch between the first stable state and the second stable state. For example, the second magnetic field is produced by a coil in a row of coils, such as shown in system 400 of FIG. 4, or in an array of coils, such as shown in systems 600 and 900 of FIGS. 6 and 9, respectively. The coil operates similarly to coil 114 shown in FIGS. 1A-1D. The second magnetic field switches cantilever 112 between two stable states, such as the first and second stable states described above. As described above, only a temporary application of the second magnetic field produced by the coil is required to change direction of magnetization vector "m" shown in FIG. 2. Changing the direction of magnetization vector "m" causes cantilever 112 to switch between the first stable state and the second stable state.

Thus, any switch in an array of switches described above may be actuated in this manner. Further ways of actuating micro-magnetic latching switches of the present invention will be apparent to persons skilled in the relevant art(s) from the teachings herein.

CONCLUSION

The corresponding structures, materials, acts and equivalents of all elements in the claims below are intended to include any structure, material or acts for performing the functions in combination with other claimed elements as specifically claimed. Moreover, the steps recited in any method claims may be executed in any order. The scope of the invention should be determined by the appended claims and their legal equivalents, rather than by the examples given above. Finally, it should be emphasized that none of the elements or components described above are essential or critical to the practice of the invention, except as specifically noted herein.

What is claimed is:

1. A system for actuating micro-magnetic latching switches in an array of micro-magnetic latching switches, wherein the array of switches is defined by Y rows aligned with a first axis and X columns aligned with a second axis, and wherein each switch in the array of switches is capable of being actuated by a coil, comprising:

a row of coils that includes X individually addressable coils;

a step motor that moves said row of coils along the second axis to be positioned adjacent to any one of the Y rows of switches, wherein when said row of coils is positioned adjacent to a selected one of the Y rows of switches, coils in said row of coils are positioned adjacent to corresponding switches in said selected one of the Y rows of switches;

a coil driver that provides a sufficient driving current to a selected coil in said row of coils to actuate a selected switch in the array of switches when said selected coil is positioned adjacent to said selected switch;

a step motor driver that drives said step motor; and a controller coupled to said coil driver and said step motor driver.

2. The system of claim 1, wherein said controller instructs said step motor to position said row of coils adjacent to said selected one of the Y rows of switches, and further instructs said coil driver to activate said selected coil of said row of coils, whereby said selected switch in the array is actuated.

3. The system of claim 1, wherein said controller is a micro-controller.

4. The system of claim 3, wherein said micro-controller is coupled to a system data bus.

5. The system of claim 1, further comprising:

an encoder coupled to said controller, wherein said encoder determines a position of said row of coils along the second axis.

6. The system of claim 1, further comprising:

a memory coupled to said controller, wherein said memory stores a status map that includes an indication of a state of each switch in the array of switches.

7. The system of claim 1, wherein each switch in the array of switches comprises:

a moveable element supported by a substrate and having a magnetic material and a long axis; and at least one magnet that produces a first magnetic field, which induces a magnetization in said magnetic material, said magnetization characterized by a magnetization vector pointing in a direction along said long axis of said moveable element, wherein said first magnetic field is approximately perpendicular to a major central portion of said long axis.

8. The system of claim 7, wherein said selected coil actuates said selected switch by producing a second magnetic field in response to the sufficient driving current, wherein the second magnetic field switches a respective moveable element of the switch between first and second stable states, wherein temporary application of the second magnetic field is required to change direction of the magnetization vector thereby causing the respective moveable element of said selected switch to switch between the first and second stable states.

9. A method for actuating micro-magnetic latching switches in an array of micro-magnetic latching switches, wherein the array of switches is defined by Y rows aligned with a first axis and X columns aligned with a second axis, and wherein each switch in the array of switches is capable of being actuated by a coil, comprising:

(A) moving a row of coils along the second axis to be positioned adjacent to a selected one of the Y rows of switches; and (B) providing a sufficient driving current to a selected coil in the row of coils to actuate a selected switch in the selected one of the Y rows of switches.

10. The method of claim 9, wherein step (A) comprises:

controlling a step motor to position the row of coils adjacent to the selected one of the Y rows of switches.

11. The method of claim 9, wherein step (B) comprises:

controlling a coil driver to supply the driving current to the selected coil in the row of coils.

12. The method of claim 9, further comprising:

(C) prior to step (A), determining a present position of the row of coils along the second axis.

13. The method of claim 12, further comprising:

(D) prior to step (A), receiving a command to position the row of coils along the second axis adjacent to the selected one of the Y rows of switches.

14. The method of claim 13, further comprising:

(E) determining a distance to the selected one of the Y rows of switches from the determined present position of the row of coils.

15. The method of claim 14, wherein step (A) comprises:

moving the row of coils the determined distance along the second axis.

16. The method of claim 9, further comprising:

(C) storing a status map that includes an indication of a state of each switch in the array of switches.

17. The method of claim 16, further comprising:

(D) transmitting information related to the state of at least one switch stored in the status map over a system data bus.

18. The method of claim 9, wherein each switch in the array of switches includes a permanent magnet that produces a first magnetic field which induces a magnetization in a magnetic material of a moveable element of the respective switch, the magnetization characterized by a magnetization vector pointing in a direction along a longitudinal axis of the moveable element, the first magnetic field being approximately perpendicular to the longitudinal axis, further comprising:

(C) producing a second magnetic field with the selected coil in response to the driving current to switch the moveable element of the selected switch between a first stable state and a second stable state, wherein temporary application of the second magnetic field is required to change direction of the magnetization vector thereby causing the moveable element of the selected switch to switch between the first table state and the second stable state.

* * * * *